US009808094B2

(12) United States Patent
Schulz, Jr.

(10) Patent No.: US 9,808,094 B2
(45) Date of Patent: Nov. 7, 2017

(54) ALL TRUSS FOUNDATION UNIT, METHOD OF MAKING THE SAME AND FOUNDATION UNIT KIT

(71) Applicant: Rock Island Industries, Hempstead, TX (US)

(72) Inventor: Martin Schulz, Jr., Brenham, TX (US)

(73) Assignee: Rock Island Industries, Hempstead, TX (US)

( * ) Notice: Subject to any disclaimer, the term of this patent is extended or adjusted under 35 U.S.C. 154(b) by 423 days.

(21) Appl. No.: 14/602,813

(22) Filed: Jan. 22, 2015

(65) Prior Publication Data

US 2015/0128342 A1 May 14, 2015

Related U.S. Application Data

(63) Continuation of application No. 13/536,136, filed on Jun. 28, 2012, now Pat. No. 8,959,678.

(60) Provisional application No. 61/503,894, filed on Jul. 1, 2011.

(51) Int. Cl.

| | |
|---|---|
| ***A47C 19/00*** | (2006.01) |
| ***A47C 23/06*** | (2006.01) |
| ***A47C 19/02*** | (2006.01) |

(52) U.S. Cl.

CPC ..... *A47C 23/061* (2013.01); *A47C 19/025* (2013.01); *Y10T 29/49817* (2015.01); *Y10T 29/49826* (2015.01); *Y10T 29/49899* (2015.01)

(58) Field of Classification Search

CPC . A47C 23/061; A47C 19/025; Y10T 29/4987; Y10T 29/49826; Y10T 29/49899

USPC ..... 5/400, 279.1, 282.1, 286, 186.1, 200.1, 5/191, 236.1; 108/51.11, 57.17, 57.19, 108/56.1, 56.3, 57.33; 52/223.8, 690, 52/692, 837, 838

See application file for complete search history.

(56) References Cited

U.S. PATENT DOCUMENTS

| | | | | |
|---|---|---|---|---|
| 3,298,151 A | | 1/1967 | Jureit | |
| 4,074,372 A | | 2/1978 | Schulz, Jr. | |
| 5,099,529 A | | 3/1992 | Anderson | |
| 5,809,907 A | | 9/1998 | Bumgarner | |
| 5,983,423 A | * | 11/1999 | Rupe | A47C 19/021 5/200.1 |
| 6,145,270 A | * | 11/2000 | Hillman | E01D 2/00 14/6 |
| 7,562,499 B2 | * | 7/2009 | Hillman | E01D 2/02 52/223.8 |
| 8,042,205 B2 | * | 10/2011 | Schulz, Jr. | A47C 19/005 5/200.1 |

(Continued)

*Primary Examiner* — David E Sosnowski
(74) *Attorney, Agent, or Firm* — Barnes & Thornburg LLP

(57) ABSTRACT

An all truss foundation unit, method of making the foundation unit, and a foundation unit kit. The foundation unit is formed of multiple cross trusses interconnected by bridging top and bottom side rails. This results in a flat surface on both the top and the bottom of the foundation unit. The kit is formed of a plurality of the trusses and four side rails, with the trusses and side rails being oriented together with their longitudinal dimensions aligned in a generally parallel orientation and with at least some of their flat sides in contact with one another. When the foundation unit is constructed, a truss locator guide is provided on at least two of the side rails, and the cross trusses are oriented in a parallel, spaced relationship in accordance with the truss locator guide.

12 Claims, 4 Drawing Sheets

(56) References Cited

U.S. PATENT DOCUMENTS

| | | | | |
|---|---|---|---|---|
| 8,091,161 | B1 * | 1/2012 | Schulz, Jr. | A47C 23/00 5/186.1 |
| 8,176,581 | B2 * | 5/2012 | Schulz, Jr. | A47C 19/005 5/200.1 |
| 8,621,797 | B2 | 1/2014 | Kim et al. | |
| 2008/0052825 | A1 * | 3/2008 | Wolff | A47C 19/005 5/201 |
| 2008/0208709 | A1 | 8/2008 | Craver | |
| 2008/0235868 | A1 | 10/2008 | Snitzer et al. | |
| 2009/0000030 | A1 | 1/2009 | Hicks et al. | |
| 2009/0013464 | A1 * | 1/2009 | Tarquinio | A47C 19/005 5/200.1 |
| 2009/0025143 | A1 * | 1/2009 | Oh | A47C 19/005 5/201 |
| 2010/0154118 | A1 | 6/2010 | Pearce | |
| 2010/0170190 | A1 * | 7/2010 | Schulz, Jr. | A47C 19/005 52/745.19 |
| 2010/0175187 | A1 | 7/2010 | Hall | |
| 2010/0275372 | A1 | 11/2010 | Oh | |
| 2011/0258777 | A1 * | 10/2011 | Schulz, Jr. | A47C 19/005 5/286 |
| 2012/0240335 | A1 | 9/2012 | Sauter et al. | |
| 2013/0000038 | A1 * | 1/2013 | Schulz, Jr. | A47C 19/025 5/400 |
| 2013/0097947 | A1 * | 4/2013 | Kim | E01D 2/00 52/223.8 |
| 2013/0180437 | A1 * | 7/2013 | Wilcox | B65D 7/24 108/56.3 |
| 2013/0187320 | A1 * | 7/2013 | Henselmeyer | B60G 13/003 267/292 |
| 2014/0137492 | A1 * | 5/2014 | French | B28B 7/186 52/223.6 |

* cited by examiner

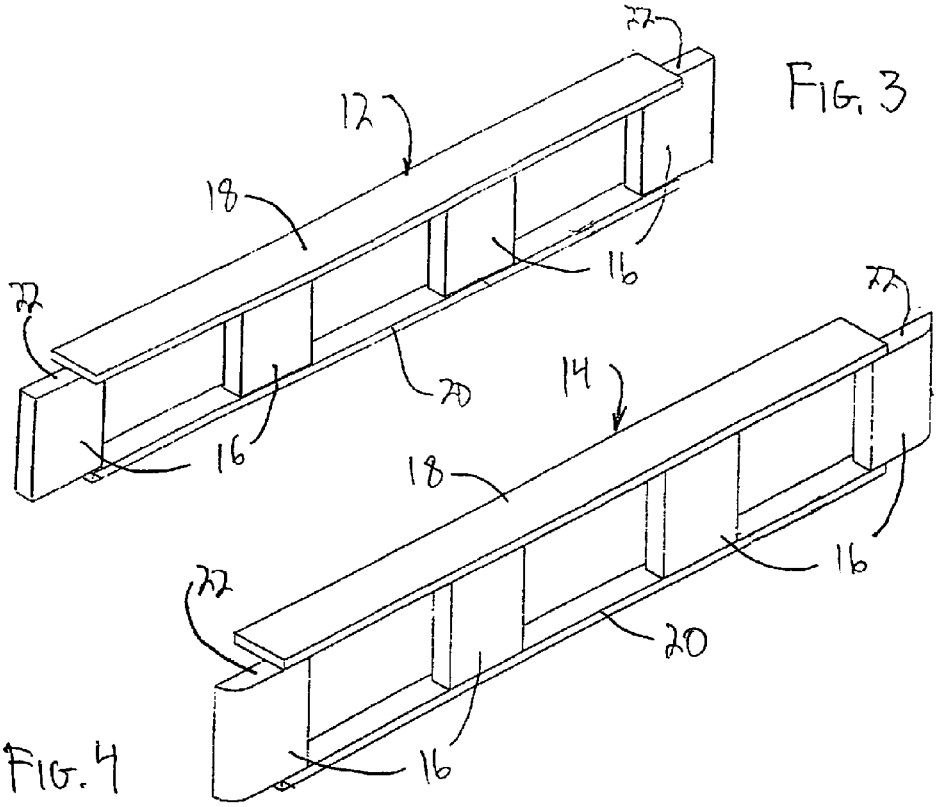
FIG. 3
FIG. 4
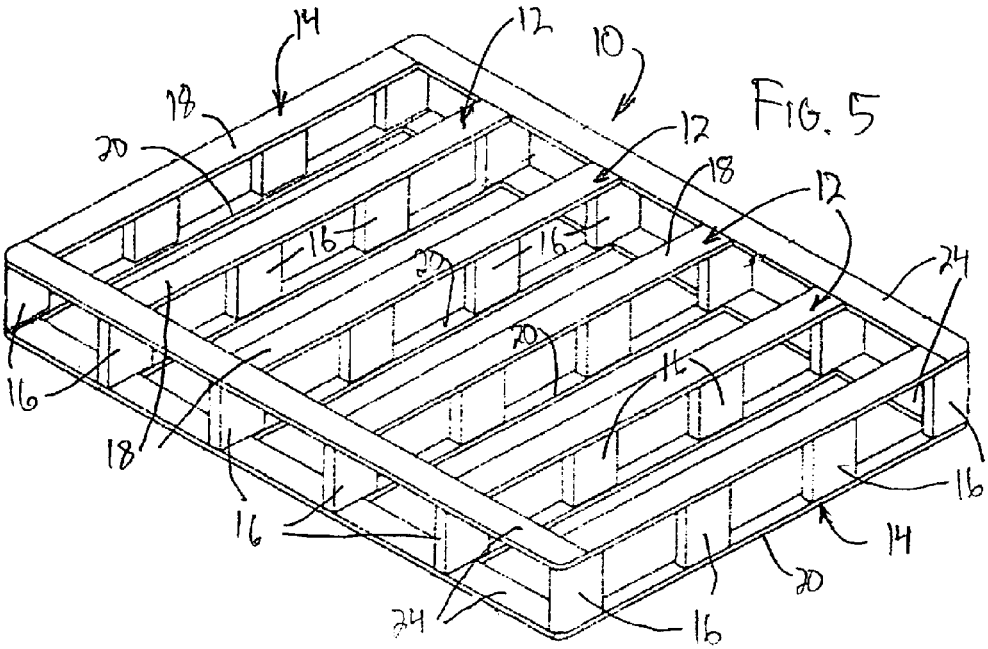
FIG. 5

ALL TRUSS FOUNDATION UNIT, METHOD OF MAKING THE SAME AND FOUNDATION UNIT KIT

BACKGROUND OF THE INVENTION

This invention relates to foundation units, and in particular to a foundation unit comprised of pre-formed cross trusses interconnected by bridging top and bottom side rails.

Foundation units have been manufactured by the bedding industry for decades. One type of foundation unit is disclosed in the applicant's U.S. Pat. Nos. 8,042,205 and 8,176,581, the disclosures of which are incorporated herein by reference.

The time taken to assemble a foundation unit is always of concern, as well as the amount of labor involved. The present invention permits extremely fast assembly of a foundation unit and therefore reduced cost.

SUMMARY OF THE INVENTION

One form of the invention is directed to a method of making a foundation unit. It comprises the steps of providing at least three elongated, preassembled cross trusses having top and bottom rail notches and four side rails. The cross trusses and side rails are assembled into a compact kit. Subsequently, the kit is opened and the cross trusses are oriented in a spaced, parallel position with a first of the two side rails bridging the cross trusses in the top rail notches thereof. Then, the first two side rails are affixed to the cross trusses to form a partial foundation. The partial foundation is then inverted, two further side rails are placed in the bottom rail notches of the cross trusses, which are now on top, bridging the cross trusses, and the further side rails are affixed to the cross trusses.

In this form of the invention, at least two of the side rails each include a truss locator guide. When the kit is opened and the cross trusses are oriented in a spaced, parallel position, the two side rails with the truss locator guide are located in the bottom rail notches of the cross trusses, and the cross trusses are oriented in accordance with the truss locator guide. Preferably, the truss locator guide comprises a plurality of spaced orienting marks.

The foundation unit kit comprises at least three elongated, generally flat trusses each having a longitudinal dimension and flat sides, with the trusses having top and bottom rail notches. Four generally flat side rails are provided, each side rail having a longitudinal dimension and flat sides. The cross trusses and the side rails are oriented together with their longitudinal dimensions aligned in a generally parallel orientation and with at least some of their flat sides in contact with one another. A binding is used to maintain the cross trusses and side rails in their orientation.

In another form of the method according to the invention, the foundation unit is assembled by providing at least three elongated cross trusses, each having top and bottom rail notches in opposite ends thereof. Four side rails are provided, shaped to engage the rail notches. The cross trusses are oriented in a spaced, parallel position with a first two of the side rails bridging the cross trusses in top rail notches those first two side rails are affixed to the cross trusses in the top rail notches to form a partial foundation, which is then inverted. The further two side rails are then placed in the now-inverted bottom rail notches of the cross truss of the inverted partial foundation bridging the cross trusses, and are affixed to the cross trusses.

BRIEF DESCRIPTION OF THE DRAWINGS

The invention is described in further detail in the following description of examples embodying the best mode of the invention, taken in conjunction with the drawing figures, in which:

FIG. 3 is an isometric view of one of the center cross trusses, FIG. 4 is an isometric view of one of the end cross trusses, FIG. 5 is an isometric view of an assembled foundation unit, prior to application of any covering.

DESCRIPTION OF EXAMPLES EMBODYING THE BEST MODE OF THE INVENTION

Figure 1:
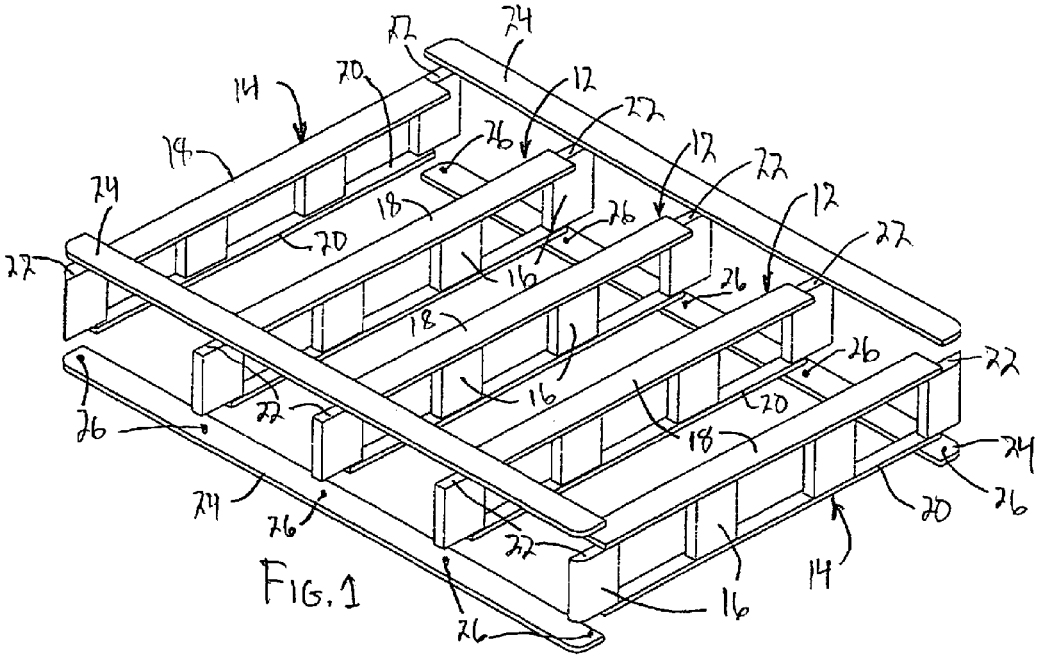
FIG. 1 is an isometric assembly view of a foundation unit according to the invention.
Figure 2:
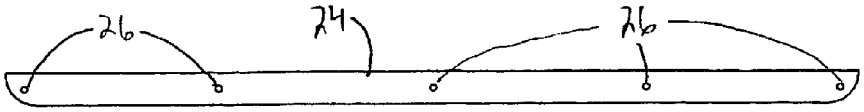
FIG. 2 is an elevational illustration of one of the side rails.

An assembled all truss foundation unit according to the invention is shown at 10 in FIG. 5, with its assembly and components being shown in FIGS. 1-4. The foundation unit 10 is composed of a plurality of cross trusses that are regularly spaced. As shown in FIGS. 1 and 2-5, preferably two types of cross trusses are provided, although all of the cross trusses may be identical, if desired. Center cross trusses 12 are included between end cross trusses 14. The only difference between the center cross trusses 12 and the end cross trusses 14 are, in the end cross trusses 14, radiusing of outer supports for aesthetic purposes. As just noted, however, the cross trusses 12 and 14 can be identical to one another.

Each of the cross trusses 12 and 14 includes spaced block supports 16 extending between top slats 18 and bottom slats 20. While the top slats 18 are illustrated as wider than the bottom slats 20, the slats 18 and 20 can be identical. The block supports 16 are provided at sufficient intervals to provide desired rigidity to the cross trusses 12 and 14. Preferably the cross trusses 12 and 14 are formed of wood, although they can be made of other materials, as desired, or can be combinations of wood and other materials, such as plastic elements, or entirely composite materials.

All of the trusses 12 and 14 have notches 22 formed therein, preferably by simple location of end block supports 16 extending outwardly from the ends of the top and bottom slats 18 and 20. The notches 22 are formed to accommodate top and bottom side rails 24.

At least the bottom of the side rails 24 include a locator guide in the form of a series of spaced orienting marks 26. The marks are located where the cross trusses 12 and 14 are to be affixed to the side rails 24, thus providing a ready guide for assembly of the foundation unit 10 without the need for a jig or other arrangement to orient the cross trusses 12 and 14. Obviously, so as not to have to differentiate between top and bottom members of the side rails 24, all of the side rails 24 can include the orienting marks 26.

The cross trusses 12 and 14 are preassembled. That is, when the kit described below is shipped, the cross trusses 12 and 14 are already in the form shown in the drawing figures. Depending on the materials of the cross trusses 12 and 14, their assembly can be by nailing, screwing, gluing, welding or molding the elements together. It is simply required that the cross trusses 12 and 14 be in the form shown.

Assembly of the foundation unit 10 is simple and quick. First, the bottom rails 24 are placed on a flat surface with the marks 26 oriented upwardly, as shown in FIG. 1. Then, the cross trusses 12 and 14 are placed on the bottom rails, oriented with the marks 26. Next, the top rails 24 are appropriately placed in the notches 22 and affixed to the cross trusses 12 and 14 in the notches, as by nailing, screwing, gluing or otherwise affixing them, as appropriate. The partially formed foundation is then inverted, and the bottom two of the side rails 24 (now on top) are installed in their respective notches 26 on the trusses 12 and 14. The final side rails are appropriately affixed, just as the first pair of side rails was affixed. The side rails can be affixed by nailing, screwing, gluing, or any other means of fixing the side rails in the notches.

Depending on the length and rigidity of the foundation unit 10, any number of the center cross trusses 12 can be used. Thus, in the assembly drawing of FIG. 1, there are three center cross trusses and two end cross trusses. In the completed foundation 10 shown in FIG. 5, there are four of the center cross trusses and two end cross trusses. The width and length of the foundation 10, as well as the rigidity required, will dictate how many of the center cross trusses 12 are employed. And, as explained above, while for aesthetic purposes it is preferred that end cross trusses 14 be employed with radiused ends (and conforming radiused ends of the side rails 24), the foundation unit 10 can be formed simply with cross trusses of the nature of the second cross trusses 12, and with conforming side rails 24.

For greater strength, each of the cross trusses 12 and 14 can include a pre-stress. To that end, preferably the block supports 16 centrally between the end block supports have a vertical dimension greater than the vertical dimensions of the end block supports. That is, in the version shown in FIGS. 1-5, each of the cross trusses 12 and 14 include opposite ends support blocks 16, with central support blocks 16 therebetween. The central support block are formed slightly longer than the end support blocks so that each cross truss 12 and 14 is bowed upwardly in the central portion thereof. Thus, when a mattress is supported on the foundation, the central bowing becomes a pre-stress, providing greater strength and less sagging in a bedding unit comprising the foundation according to the invention, topped with a mattress. Sagging is virtually eliminated, in distinction from a conventional foundation which has a longitudinal stringer in the center which runs head to foot, and which therefore provides very little support and resistance against sagging of the foundation unit in the middle.

Figure 6:
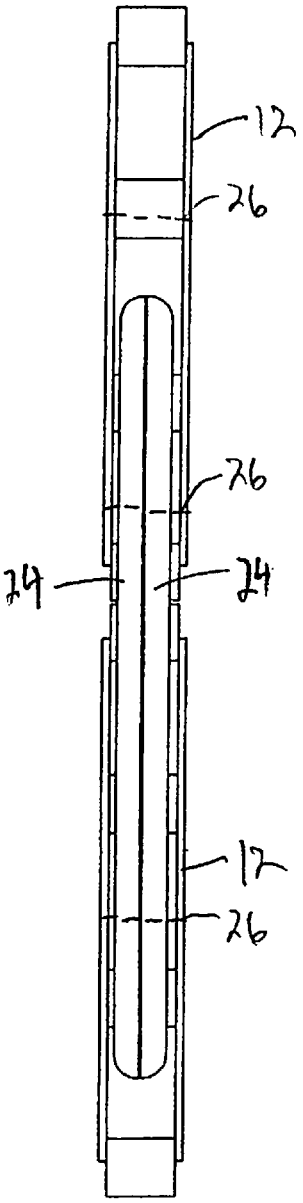
FIG. 6 is a front elevational illustration of a foundation unit kit, without the binding being shown.
Figure 7:
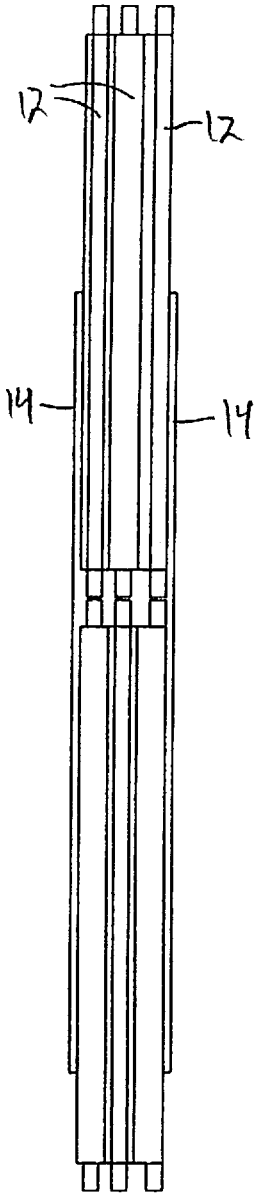
FIG. 7 is a side elevational illustration thereof.

A foundation unit kit is shown in FIGS. 6 and 7. The kit shown in FIGS. 6 and 7 comprises six of the cross trusses (two end cross trusses 14 and four center cross trusses 12), bundled together with four of the side rails 24. Appropriate strapping or other means of affixing is used to bundle the units shown in FIGS. 6 and 7 into a compact kit. Simply for purposes of illustration, the dotted lines 28 are shown on FIG. 6 to illustrate how strapping can be used.

Figure 8:
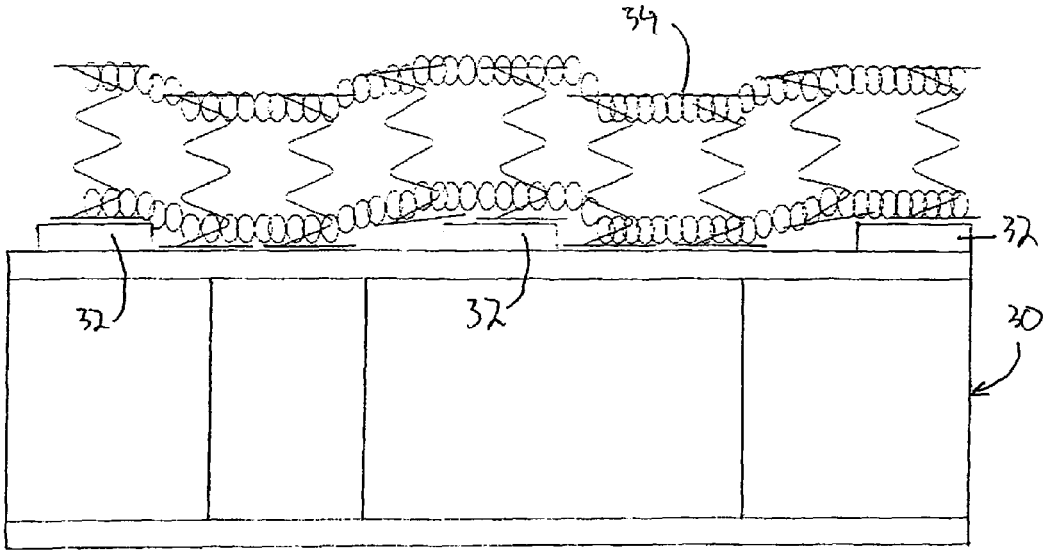
FIG. 8 illustrates, in a somewhat exaggerated form, how prior art foundation units provide insufficient support for mattresses.

FIG. 8 illustrates support of a mattress on a conventional foundation unit, not that of the present invention. As shown, the foundation unit 30 includes a series of spaced, parallel cross slats 32 on the top thereof. When a mattress 34 is situated atop the foundation unit 30, the mattress 34 tends to sag into gaps between the cross slats 32. Not only does the foundation 30 present a less than pleasing appearance of the mattress 34, but also the life of the mattress 34 is decreased without a consistent side edge support.

Figure 9:
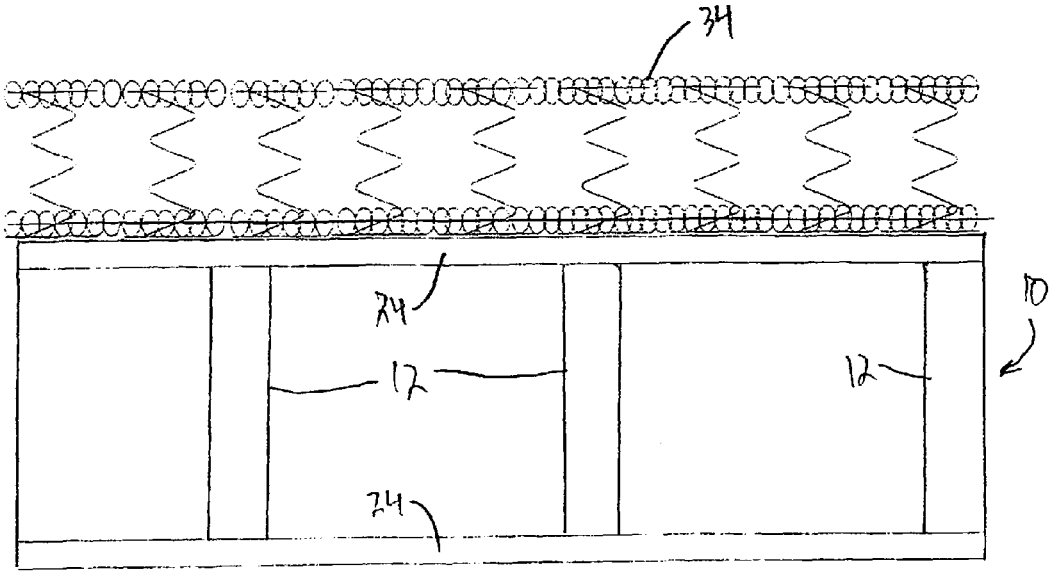
FIG. 9 illustrates how the present invention provides proper, flat surface support for mattresses.

The invention of the present application avoids the problems of conventional foundations, as shown in FIG. 8. As illustrated in FIG. 9, the foundation unit 10, with its perfectly flat top surface by means of the coplanar top slats 18 and side rails 24, perfectly supports the outer row of coils in the mattress 34, providing extra life to the edge of the mattress. It provides a better edge appearance and a better tailoring appearance for the mattress 34.

Various exchanges can be made to the invention without departing from the spirit thereof or scope of the following claims.

What is claimed is:

1. A foundation unit for supporting a mattress, said foundation unit comprising:

a plurality of elongate cross trusses, each cross truss extending between a first end and a second end, each cross truss including a bottom slat having a first end and a second end and a top slat having a first end and a second end, said top slat having a generally flat top surface, said top slat being spaced apart from and above said bottom slat, each said cross truss including a first top notch at said first end of said cross truss adjacent said first end of said top slat, a second top notch at said second end of said cross truss adjacent said second end of said top slat, a first bottom notch at said first end of said cross truss adjacent said first end of said bottom slat, and a second bottom notch at said second end of said cross truss adjacent said second end of said bottom slat;

a first bottom side rail and a second bottom side rail, each bottom side rail having a first end and a second end, said first bottom side rail adapted to be located in said first bottom notches of said cross trusses, said second bottom side rail adapted to be located in said second bottom notches of said cross trusses;

a first top side rail and a second top side rail, each said top side rail having a first end and a second end and a generally flat top surface, said first top side rail adapted to be located in said first top notches of said cross trusses with said flat top surface of said first top side rail being generally coplanar with said flat top surfaces of said top slats of said cross trusses, said second top rail adapted to be located in said second top notches of said cross trusses with said flat top surface of said second top side rail being generally coplanar with said flat top surfaces of said top slats of said cross trusses, said flat top surfaces of said top slats of said cross trusses and said flat top surfaces of said first and second top rails forming a generally flat top surface of the foundation unit adapted to support the mattress; and wherein each cross truss includes a pre-stress and at least one center support located between opposite end supports, said pre-stress comprising said at least one center support having a vertical dimension greater than vertical dimensions of said end supports.

2. The foundation unit of claim 1, wherein each said bottom slat of said cross trusses includes a generally flat bottom surface, said first and second bottom side rails each including a generally flat bottom surface that is generally coplanar with said flat bottom surfaces of said bottom slats of said cross trusses, whereby said foundation unit may be inverted such that said coplanar bottom surfaces of said first and second bottom side rails and of said bottom slats of said cross trusses are adapted to support the mattress.

3. The foundation unit of claim 1, wherein said top slats of said cross trusses have a first width, and said bottom slats of said cross trusses have a second width, said first width being wider than said second width.

4. The foundation unit of claim 1, wherein said center support and said end supports of each said cross truss extend between said bottom slat and said top slat of said cross truss.

5. The foundation unit of claim 4, wherein a first end support of each cross truss extends outwardly beyond said first end of said top slat of said cross truss to form said first top notch, and said first end support extends outwardly beyond said first end of said bottom slat to form said first bottom notch.

6. The foundation unit of claim 5, wherein said first top side rail is adapted to be coupled to a top end of said first end support of each said cross truss, and said first bottom side rail is adapted to be coupled to a bottom end of said first end support of each said cross truss.

7. The foundation unit of claim 5, wherein a second end support of each cross truss extends outwardly beyond said second end of said top slat of said cross truss to form said second top notch, and said second end support extends outwardly beyond said second end of said bottom slat of said cross truss to form said second bottom notch.

8. The foundation unit of claim 7, wherein said second top side rail is adapted to be coupled to a top end of said second end support of each said cross truss, and said second bottom side rail is adapted to be coupled to a bottom end of said second end support of each said cross truss.

9. The foundation unit of claim 4, wherein each said support of said cross trusses comprises a block support.

10. The foundation unit of claim 1, wherein the plurality of elongate cross trusses includes at least three cross trusses.

11. The foundation unit of claim 1, wherein said cross trusses are all constructed substantially identical to one another.

12. The foundation unit of claim 11, wherein said first and second bottom side rails and said first and second top side rails are all constructed substantially identical to one another.

* * * * *